US008866572B2

(12) United States Patent
McMullen

(10) Patent No.: US 8,866,572 B2
(45) Date of Patent: Oct. 21, 2014

(54) SPECIAL RANDOM MAGNETIZATION APPARATUS AND PROCESS FOR THIN SHEET MAGNETIC SHEETS AND ROLLS

(76) Inventor: A. Todd McMullen, Pendleton, IN (US)

( * ) Notice: Subject to any disclaimer, the term of this patent is extended or adjusted under 35 U.S.C. 154(b) by 39 days.

(21) Appl. No.: 13/400,043

(22) Filed: Feb. 18, 2012

(65) Prior Publication Data

US 2012/0213942 A1 Aug. 23, 2012

Related U.S. Application Data

(60) Provisional application No. 61/444,707, filed on Feb. 19, 2011.

(51) Int. Cl.
*H01F 7/20* (2006.01)
*H01F 13/00* (2006.01)

(52) U.S. Cl.
CPC ..... *H01F 13/003* (2013.01)
USPC ..... 335/284; 335/302

(58) Field of Classification Search
CPC ..... H01F 13/006; H01F 13/00; H01F 13/003; H01F 7/0215; H02K 15/03
USPC ..... 335/284, 302
See application file for complete search history.

(56) References Cited

U.S. PATENT DOCUMENTS

| | | | | |
|---|---|---|---|---|
| 3,127,544 | A * | 3/1964 | Blume, Jr. | 335/284 |
| 4,379,276 | A * | 4/1983 | Bouchara et al. | 335/284 |
| 5,428,332 | A * | 6/1995 | Srail et al. | 335/302 |
| 5,503,891 | A | 4/1996 | Marshall et al. | |
| 5,942,961 | A * | 8/1999 | Srail et al. | 335/284 |
| 5,994,990 | A | 11/1999 | Ogikubo | |
| 6,454,686 | B1 * | 9/2002 | McEachern | 492/8 |
| 6,853,280 | B2 * | 2/2005 | Sugawara et al. | 335/284 |
| 6,881,450 | B1 | 4/2005 | Texier | |
| 7,040,665 | B2 | 5/2006 | Ritchie et al. | |
| 7,728,706 | B2 * | 6/2010 | Ogden et al. | 335/284 |
| 8,410,880 | B2 * | 4/2013 | Ball et al. | 335/284 |
| 8,410,881 | B2 * | 4/2013 | Ball, Sr. | 335/284 |

FOREIGN PATENT DOCUMENTS

| | | | |
|---|---|---|---|
| EP | 218044 | A1 * | 4/1987 |
| EP | 0639292 | A1 * | 2/1995 |

* cited by examiner

*Primary Examiner* — Mohamad Musleh
(74) *Attorney, Agent, or Firm* — Ritchison Law Offices; John D Ritchison

(57) ABSTRACT

A magnetization apparatus and process for producing thin magnetized sheets and rolls. It has permanent magnet pieces oriented and magnetized perpendicular to the other components of soft pole piece surfaces. This orientation permits the adjustably controlled field strength of the magnetic field produced. By varying the number of pole pieces and the corresponding permanent magnets the magnetic coupling and magnetic field strength varies. This field variance shifts the aligned poles into a "random orientation". Therefor the alignment of like poles on the consecutive sheets is avoided and the sheets can lay flat and not be repelled by aligned poles.

5 Claims, 12 Drawing Sheets

51
53
50

52
53

54

41
40
43

42
43

44

31

73,77
84
801
81

77, PM
RE Magnets
73,SP
Magnetically soft
Pole pieces 80
801

75
71
80

B
B
83
73,77
80

73,77
801
82

81

Sheets with Uniform Magnetization

90

95

Average equals 16PPI for a 24 inch roller: PPI (AVG) = PA

**PA = {[( PA+1)*4] + [(PA -2)*4] + [(PA)*4] + [(PA + 2)*2] + [(PA – 2)*3] + [(PA + 1)*4] +[PA*2] + [(PA +2) *1]} / 24**

51
53
50

52
53

54

41
40
43

42
43

44

31

SPECIAL RANDOM MAGNETIZATION APPARATUS AND PROCESS FOR THIN SHEET MAGNETIC SHEETS AND ROLLS

CROSS-REFERENCE TO RELATED APPLICATIONS

This application claims the benefit of Provisional Patent Application Ser. No. 61/444,707 filed Feb. 19, 2011, by A. Todd McMullen and entitled "Special random magnetization apparatus and process for thin sheet magnetic sheets and rolls".

FIELD OF INVENTION

This invention relates to a special magnetization apparatus and process for thin sheet magnetic sheets and rolls. Particularly this new idea and concept is a product that is related to flat magnetizable sheets and objects. Likewise, the concept reveals a method to manufacture the product. Flat sheets that are magnetized are renowned for the mis-aligned edges that are caused during production and use. These staggered edges are the result of the uniform magnetic poles of the sheet magnet aligning and positioning "like poles" (North to North, South to South) across from each other. Those skilled in the art of magnetized products well understand that the like poles repel. Therefore the sheet slips or staggers sideways to "find" an unlike pole on a contiguous sheet and become attracted, align, and stabilize its position.

The special magnetization apparatus and process for thin sheet magnetic sheets and rolls is accomplished by shifting the uniform aligned poles into a "randomness" condition. Therefor the alignment of like poles is avoided and the sheets can lay flat and not be repelled. This randomness may be created by the means for magnetizing as the sheet takes on its magnetic state. This means and resultant and randomly magnetized sheets will be described and discussed fully below.

FEDERALLY SPONSORED RESEARCH

None.

SEQUENCE LISTING OR PROGRAM

None.

BACKGROUND

Field of Invention and Prior Art

A. Problem Addressed

As far as known, there are no special magnetization apparatus and process for thin sheet magnetic sheets and rolls in prior art like this one shown herein. It is believed that this product is unique in its design and technologies. The problem to be solved is the staggering of the magnetized sheets at the edges, which prevents easy material handling and alignment of magnetized sheets. This prevents simple, thin sheets that are magnetized from easily being aligned for printing, assembling or using in a high volume situation such as manufacturing. The sheets simply stagger and mis-align and create a material handling nightmare for precise printing or manufacturing without complex handling techniques. The special magnetization apparatus and process for thin sheet magnetic sheets and rolls solves this problem by varying (or adjusting) the number of pole pieces and the corresponding permanent magnets the magnetic coupling and magnetic field strength varies. The randomization in the magnetizing pattern is produced by varying the number of magnetic poles per inch resulting in narrowing or widening the magnetization pitch with multiple poles.

B. Prior Art

Prior art such as the flexible magnet attractant display mat shown by Marshall et al in U.S. Pat. No. 5,503,891 (1996) describes the existing art. Here a flexible mat or sheet has one surface of a sheet, cardboard or plastic with a magnetic backing. That type of sheet is created by one of several means. One such means is described in U.S. Pat. No. 6,881,450 by Texier in 2005. There the ferromagnetic particles were homogenized in a binder (such as paint or a resin) and then applied to the backing sheet. That sheet or thin roll was subsequently passed by a uniformly magnetizing means as shown in the same Texier art. The problem to be solved is that the uniform sheets then aligned the same poles "North to North" or "South to South" once the sheets were cut and stacked. Then, the individual sheets slipped and aligned with poles opposite (North to South) and the edges resulted in a staggered or slipped condition.

In 1999 Ogikubu obtained a U.S. Pat. No. 5,994,990 for a magnetic sheet for display. It taught a magnet sheet that is formed by molding a material obtained by adding magnetic particles to a synthetic resin material into a sheet and multiple pole magnetizing one surface of the sheet to form alternate N and S poles on that surface. Then a printing sheet constituted by a paper sheet such as a high quality paper sheet or a coated paper sheet or a synthetic paper sheet or a synthetic resin film, is bonded to the non-magnetized surface of the magnet sheet. This was in response to the then common use of a magnet sheet made of a material obtained by adding magnetic particles to a synthetic resin material with one surface with alternate N and S magnetic poles formed by multiple pole magnetization. It was sheet-like and flexible and could be magnetically and detachably attached to magnetic surfaces of steel boards, white boards, etc. Thus, it had applications as business displays, document binders, drawing boards, etc. to be attached to magnetic surfaces. It was difficult and expensive to manufacture and had the problems described above herein. Next, in 2006, Ritchie, et al received a U.S. Pat. No. 7,040,665 for a Carrier sheet with integrated detachable die-cut card having a magnet material backing. It was a carrier sheet comprising a printed paper sheet having an integrated detachable card with a magnetic backing and a method of manufacturing the device. The carrier sheet is comprised of a printed paper sheet having printed matter on at least a front face thereof. The printed matter contains card information printed in a card area. A polyfilm patch was adhered over the card area and over the card information printed thereon. A thin flexible patch of magnet material is adhesively secured on a rear face of the paper sheet and extends over the card area. The device and method was far more complex than the McMullen device and method shown herein.

As can be seen, the prior art is not a special magnetization apparatus and process for thin sheet magnetic sheets and rolls in prior art like this one shown herein. The new device and method are unique in its design and technologies. None of the prior art discovered and disclosed anticipate or make obvious this new technology and use for a person skilled in the art of flat, magnetized sheets.

SUMMARY OF THE INVENTION

This invention is a special magnetization apparatus and process for thin sheet magnetic sheets and rolls. Taught here are the ways that a magnetization apparatus can either rotate or remain stationary with respect to the magnetizing process. The permanent magnet pieces are magnetically oriented and magnetized perpendicular to the magnetically soft pole piece surfaces. The permanent magnets couple with the pole pieces and thereby adjustably control the field strength of the magnetic field produced in the space defined by the pole pieces. The permanent magnets are preferably formed of rare earth material either NdFeB or SmCo which has a high remnant magnetic field and a strong coercive force. By varying (or adjusting) the number of pole pieces and the corresponding permanent magnets the magnetic coupling and magnetic field strength varies.

In the preferred embodiment of the special magnetization apparatus and process for thin sheet magnetic sheets and rolls, the randomization in the magnetizing pattern is produced by varying the number of soft magnetic poles per inch resulting in narrowing or widening the magnetization pitch with multiple poles described above. The preferred embodiment is a magnetization apparatus for magnetizing a magnetizeable sheet and object comprised of at least one magnetically-soft pole piece; at least a pole piece pair consisting of a North and a South permanent magnet pole piece of a given size and volume, the permanent poles which are contiguously placed on each side of the magnetically-soft pole piece(s), whereby the soft piece(s) creating a defined space between the permanent pole pieces; a means for containing a totality of pole pieces comprised of the soft pole piece(s) and the permanent magnetic pole pieces into a specific configuration which acts as a magnetic source; and a means for moving the sheet in a close proximity to the magnetization apparatus wherein the apparatus provides a magnetic flux to the sheet defined by the from the pole pieces and the defined space of the soft pole(s) to produce a magnetic field that can vary in magnetic strength based on magnetization quality of the material and number of the soft pole piece(s) and the volume of permanent magnet material.

The newly invented special magnetization apparatus and process for thin sheet magnetic sheets and rolls may be use to manufacture at low volumes by very simple means and in high volume production by more complex and controlled systems. The scope and concept remains the randomization of the resultant sheets poles per inch by using the special apparatus and process.

OBJECTS AND ADVANTAGES

There are several objects and advantages of the special magnetization apparatus and process for thin sheet magnetic sheets and rolls. The main objective is to provide a manner for magnetizing thin sheets and rolls without creating the staggered edges of the sheets due to the magnetic repulsion of like poles. There are currently no known magnetization apparatuses or processes that are effective at providing the objects of this invention.

The special magnetization apparatus and process for thin sheet magnetic sheets and rolls may be used for:

A. Magnetic Coated Paper/Printable Magnetic Paper
B. Applications: Magnetic Signs, Message Boards, Teaching Aids, Sound Barriers
C. Magnetic Barrier Materials
D. Application: Sound or Noise Barriers
E. Military Applications: Magnetic Holding devices for various materials or barriers (stealth materials, reflective materials, etc.)
F. Medical Applications.

These applications are exemplary and not limitations to the scope of this special magnetization apparatus and process for thin sheet magnetic sheets and rolls.

Finally, other advantages and additional features of the present special magnetization apparatus and process for thin sheet magnetic sheets and rolls will be more apparent from the accompanying drawings and from the full description of the device. For one skilled in the art of magnetization devices and processes, it is readily understood that the features shown in the examples with this product are readily adapted to other types of magnetizing systems and devices.

DESCRIPTION OF THE DRAWINGS

Figures

The accompanying drawings, which are incorporated in and constitute a part of this specification, illustrate an embodiment of the special magnetization apparatus and process for thin sheet magnetic sheets and rolls that are preferred. The drawings together with the summary description given above and a detailed description given below serve to explain the principles of the special magnetization apparatus and process for thin sheet magnetic sheets and rolls. It is understood, however, that the special magnetization apparatus and process for thin sheet magnetic sheets and rolls is not limited to only the precise arrangements and instrumentalities shown.

FIGS. 2 A through 2 C are sketches of a common uniformly magnetized sheet from a TOP View, END View and a close-up showing the uniform poles per inch (PPI).

FIGS. 3 A through 3 C are sketches of a randomly magnetized sheet from a TOP View, END View and a close-up showing the random poles per inch (PPI) and an Average PPI.

FIGS. 17 A through 17 C are sketches of a uniformly magnetized sheet from a TOP View, END View and CLOSE-UP showing the staggering/slipping condition.

FIGS. 18 A through 18 C are sketches of a randomly magnetized sheet from a TOP View, END View and CLOSE-UP showing the smooth edge/no stagger condition.

DESCRIPTION OF THE DRAWINGS

Reference Numerals

Figures 1, 2A, 2B, 2C, 3A, 3B, 3C:
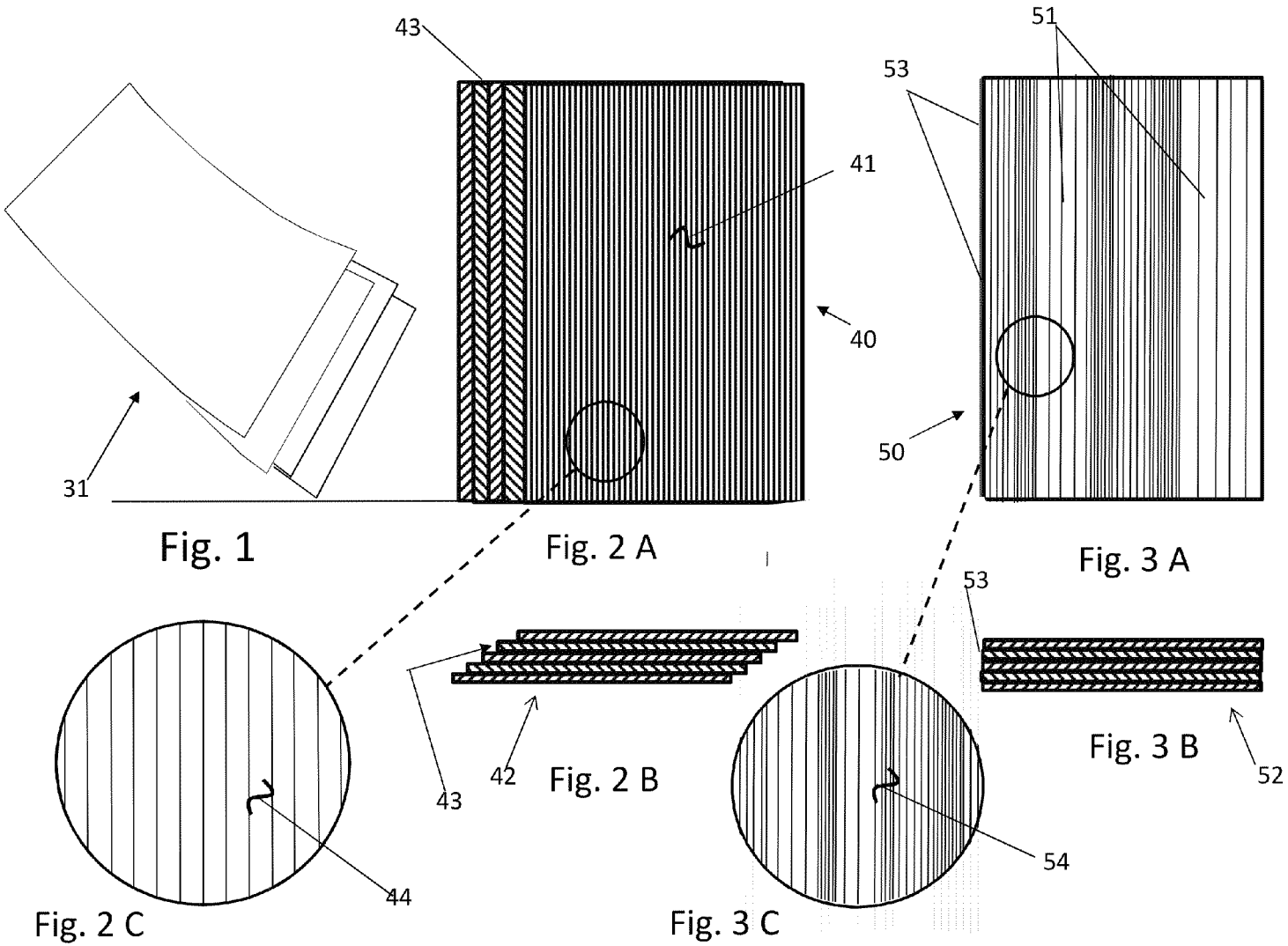
FIG. 1 is a sketch of several sheets of a sample magnetized sheet. The edges are staggered since the sheets are uniformly magnetized.

The following list refers to the drawings:

TABLE B

| Reference numbers | |
|---|---|
| Ref # | Description |
| PPI | (Magnet) Poles per Inch |
| PA | (Magnet) Poles Per Inch Average |
| 31 | Sample magnetized sheet/card material |
| 40 | Uniformly Magnetized material sheet (typically produced sheet) |
| 41 | TOP View of Uniformly Magnetized material sheet |
| 42 | END View of Uniformly Magnetized material sheet |
| 43 | Staggered sheets—repelled to an uneven condition of the edges |
| 44 | Close-up of uniformly magnetized material/sheet |
| 50 | Randomly Magnetized material sheet |
| 51 | TOP View of Randomly Magnetized material sheet |
| 52 | END View of Randomly Magnetized material sheet |
| 53 | Flat, Non-Staggered sheets—attracted to even/inline/smooth condition of edges |
| 54 | Close-up of Randomly magnetized material/sheet |
| | Sheet Process |
| 60 | Random magnetization of a Sheet process |
| 61 | Mix of binder material and ferromagnetic/magnetizable materials |
| 62 | Homogenize (mix evenly) |
| 63 | Coat/apply magnetizable mixture onto medium (paper, card, plastic, metal, composite material |
| 64 | Randomly magnetize to an Average (not uniform) PPI |
| | Magnetized sheet/card/object |
| 67 | Flat sheet/card roll material |
| 68 | Magnet attractant material |
| 69 | medium (paper, card, plastic, metal, composite material) on which attractant 68 is placed |
| | Sheet/flat material and magnetizer |
| 71 | Means for coating sheet and for moving sheet past magnetizer |
| 72 | Means for randomly (or Uniformly) Magnetizing - electro magnet, permanent magnets etc. |
| 73 | Soft poles—SP ferromagnetic type material or equal |
| 75 | Direction of travel |
| 76 | Magnetized sheet or surface |
| 77 | Permanent Magnet—PM, preferred with high remanent magnetic field and a strong coercive force |
| 78 | Magnetic flux lines on magnetizer device 72 |
| 79 | Resulting Magnetic flux on magnetized sheets, materials |

TABLE B-continued

| Reference numbers | |
|---|---|
| Ref # | Description |
| | Stationary Magnetizer |
| 80 | Stationary Magnetizer apparatus |
| 81 | BOTTOM View of Stationary Magnetizer apparatus |
| 82 | CROSS-SECTION View of Stationary Magnetizer apparatus |
| 83 | TOP View of Stationary Magnetizer apparatus |
| 84 | ISOMETRIC View of Stationary Magnetizer apparatus |
| 801 | Means for containing, container of means for magnetizing 72 |
| | Cylindrical Magnetizer |
| 85 | Cylindrical Magnetizer Apparatus |
| 86 | SAMPLE of magnetizing cylinder/roller |
| 86A | Alternative SAMPLE of magnetizing cylinder |
| H | Magnetic Field |
| N | NORTH |
| S | SOUTH |
| R | REPEL |
| SH | SHIFT |
| A | ATTRACT |
| RE | Remnant |
| 76T | TOP Magnetized sheet |
| 76B | BOTTOM/LOWER Magnetized sheet |
| 90 | Examples of Permanent Magnets and varying Magnetic field (H)in profile with random (magnetic) poles per inch |
| 95 | PPI (Average) EXAMPLE EQUATION PPI (AVG) = PA = {[(PA + 1) * 4] + [(PA − 2) * 4] + [(PA) * 4] + [(PA + 2) * 2] + [(PA − 2) * 3] + [(PA + 1) * 4] + [PA * 2] + [(PA + 2) * 1]}/24 = PA |

DETAILED DESCRIPTION OF PREFERRED EMBODIMENT

The present development is a special magnetization apparatus and process for thin sheet magnetic sheets and rolls. Particularly this new idea and concept is a product that is related to flat magnetizable sheets and objects. Likewise, the concept reveals a method to manufacture the magnetizing means and product. Flat sheets that are magnetized are renowned for the mis-aligned edges that are caused during production and use. These staggered edges are the result of the uniform magnetic poles of the sheet magnet aligning and positioning "like poles" (North to North, South to South) across from each other. Those skilled in the art of magnetized products well understand that these like poles repel. Therefore the sheet slips or staggers sideways to "find" an unlike pole on a contiguous sheet and become attracted and stabilize its position.

Taught here are the special magnetization apparatus and process for thin sheet magnetic sheets and rolls is accomplished by shifting the uniform aligned poles into a "randomness". Therefore the alignment of like poles is avoided and the sheets can lay flat and not be repelled. This randomness may be created by the means for magnetizing as the sheet takes on its magnetic state. This means and resultant and randomly magnetized sheets will be described and discussed fully below. The process and apparatuses may be used for magnetizing these sheets and eliminate the problem of staggered edges. This becomes helpful as magnetized thin sheets are used in new and different ways. Some exemplary applications include but are not limited to: Magnetic Coated Paper; Printable Magnetic Paper; Magnetic Signs; Message Boards; Teaching Aids; Sound Barriers; Magnetic Barrier Materials—Sound or Noise Barriers; Military Applications (stealth materials, reflective materials, etc.); Magnetic Holding devices for various materials or barriers; Medical Applications; etc.

The random magnetization apparatus functions to provide a magnetizing apparatus and magnetizing method. The preferred embodiment of the special magnetization apparatus is comprised of at least one (and preferably two or more) magnetically-soft pole pieces and two or more permanent magnets which are provided between the magnetically-soft pole pieces (either cylindrical rings or rectangular blocks). This is to provide magnetic flux to the magnetic field. The magnetic field is defined by the space between the two magnetically soft pole pieces and can vary in magnetic strength based on magnetization quality of the magnetically soft material and the magnetic quality and volume of permanent magnet material. The apparatus can either rotate or remain stationary with respect to the magnetizing process.

The preferred embodiment is a magnetization apparatus for magnetizing a magnetizable sheet and object comprised of at least one magnetically-soft pole piece; at least a pole piece pair consisting of a North and a South permanent magnet pole piece of a given size and volume, the permanent poles which are contiguously placed on each side of the magnetically-soft pole piece(s), whereby the soft piece(s) creating a defined space between the permanent pole pieces; a means for containing a totality of pole pieces comprised of the soft pole piece(s) and the permanent magnetic pole pieces into a specific configuration which acts as a magnetic source; and a means for moving the sheet in a close proximity to the magnetization apparatus wherein the apparatus provides a magnetic flux to the sheet defined by the from the pole pieces and the defined space of the soft pole(s) to produce a magnetic field that can vary in magnetic strength based on magnetization quality of the material and number of the soft pole piece(s) and the volume of permanent magnet material.

The permanent magnet pieces are magnetically oriented and magnetized perpendicular to the magnetically soft pole piece surfaces. The permanent magnets couple with the pole pieces and thereby adjustably control the field strength of the magnetic field produced in the space defined by the pole pieces. The permanent magnets are preferably formed of rare earth material either NdFeB or SmCo which has a high remanent magnetic field and a strong coercive force. By varying (or adjusting) the number of pole pieces and the corresponding permanent magnets the magnetic coupling and magnetic field strength varies. The randomization in the magnetizing pattern is produced by varying the number of magnetic poles per inch resulting in narrowing or widening the magnetization pitch with multiple poles described above.

There is shown in FIGS. 1-18 a complete description and operative embodiment of the special magnetization apparatus and process for thin sheet magnetic sheets and rolls. In the drawings and illustrations, one notes well that the FIGS. 1-18 demonstrate the general configuration and use of this product. The various example uses are in the operation and use section, below.

The accompanying drawings, which are incorporated in and constitute a part of this specification, illustrate an embodiment of the special magnetization apparatus 72 and process 60 for thin sheet magnetic sheets and rolls that is preferred. The drawings together with the summary description given above and a detailed description given below serve to explain the principles of the special magnetization apparatus 72 and process 60 for thin sheet magnetic sheets and rolls. It is understood, however, that the random magnetization process and associated apparatuses are not limited to only the precise arrangements and instrumentalities shown. Other examples of magnetizing processes and devices are still understood by one skilled in the art of magnetization technologies and devices to be within the scope and spirit shown here.

FIG. 1 is a sketch of several sheets of a sample magnetized sheet 31. The edges are staggered since the sheets are uniformly magnetized by the current state of the art processes.

FIGS. 2 A through 2 C are sketches of a common uniformly magnetized sheet 40 from a TOP View 41 (FIG. 2 A), END View 42 (FIG. 2 B) and a close-up 44 (FIG. 2 C) showing the uniform poles per inch (PPI). As discussed below, the like poles repel and force the contiguous sheets to stagger 43 or slip over at least one pole—to an unlike pole attraction configuration (One may note FIG. 10, below).

FIGS. 3 A through 3 C are sketches of a randomly magnetized sheet 50 from a TOP View 51, END View 51 and a close-up 54 showing the random poles per inch (PPI) and an Average PPI. Here the PPI are not uniform (as shown below). However the average is like the uniform. This permits the PPI to be off-balance and the like poles (North to North or South to South) do not line up and repel. Therefore, there is no stagger or slip of the contiguous sheets and the edge condition is non-staggered/smooth or flat 53.

Figure 4:
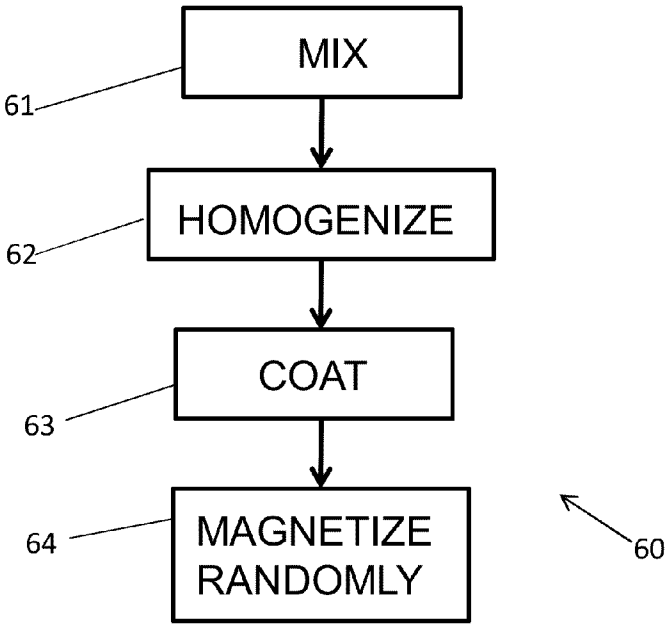
FIG. 4 is a common flow process for making a magnetizable sheet.

FIG. 4 is a common flow process 60 for making a magnetizable sheet. In this process first a binder such as paint or resin is mixed 61 with a ferromagnetic or magnetizable particles. Next, the mixture is homogenized 62 to provide a smooth and uniform solution. Then the thin, flat medium such as a sheet, plastic wafer, cardboard or the like is coated 63 with the homogenized mixture. Finally the sheet or roll is randomly magnetized 64 by some means. This results in a process as follows: a common flow process for making a magnetizable sheet comprising:

(a) first, a binder such as paint or resin with a ferromagnetic/ magnetizable particles is mixed;
(b) next, the mixture is homogenized to provide a smooth and uniform solution;
(c) then a thin, flat medium such as a sheet, plastic wafer, cardboard and the like is coated with the homogenized mixture; and
(d) finally the sheet is randomly magnetized by some means.

Figure 5:
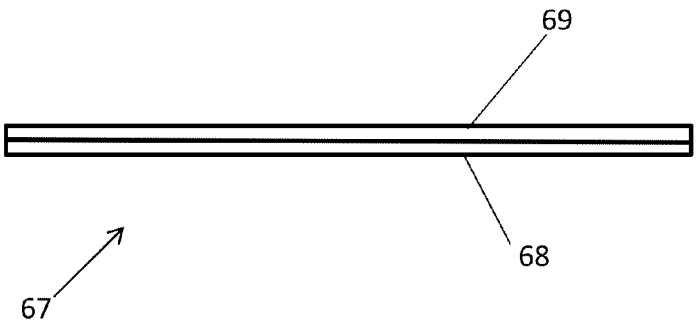
FIG. 5 is a side view of a common flat magnetizable sheet showing its common parts.

FIG. 5 is a side view of a common flat magnetizable sheet 67 showing its common parts. The normal parts include but are not limited to a magnet attractant material 68 (usually a binder and ferromagnetic material as discussed previously) and a medium 69 (paper sheet, card, plastic, metal sheet, composite material sheet or the like) for accepting the attractant material. This roll or sheet 67 is next exposed (or ready to be exposed) to a magnetizing means (not shown here).

Figures 6, 6A, 6B, 6C:
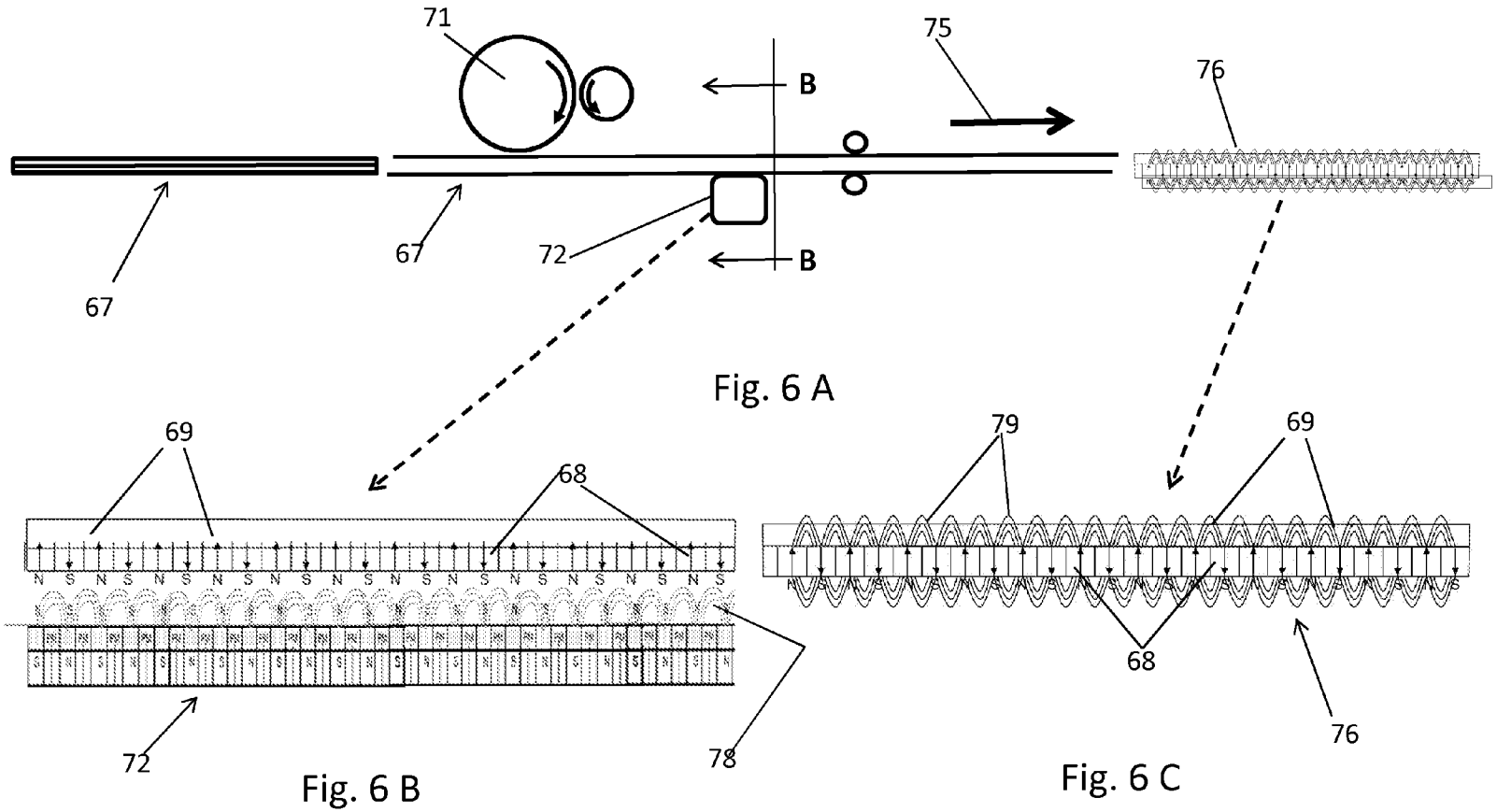
FIGS. 6 A through 6 C are sketches of magnetizable sheet running past a means for magnetizing the sheet and result in a magnetized sheet ready for use.

FIGS. 6 A through 6 C are sketches of magnetizable sheet 67 running past a means for magnetizing 72 the sheet 67 and result in a magnetized sheet 76 ready for use. In FIG. 6 A the means 71 for coating a sheet and for moving a sheet past the magnetizer is shown. Likewise, the general direction 75 is indicated. The magnetizing means 72 is further described in FIG. 6 B. Here the components of the sheet 67 are shown as the medium 69 (as already described) and the magnet attractant material 68 (a ferromagnetic material or equal in a binder or a series of soft poles SP) ready to be magnetized. The magnetizing means 72 is shown with a series of magnetic flux lines 78 emanating out and through the sheet 67 and transforming the magnetizable component into a magnetized, active sheet 76. In FIG. 6 C, the resulting, magnetized sheet 76 is further now shown with the active ferromagnetic material 68 now charged and magnetic with its own flux lines 79. One skilled in the art of magnetization realizes and well understands that the key to the magnetization and its characteristics of the resultant magnetized sheet 76 rests fully on the type and characteristics of the magnetizing means 72. If the means is a uniform and fixed Pole Per (PPI) inch of the magnetic field H (shown as flux 78), then the resultant magnetized sheet 756 will be a uniform Poles per inch (PPI). If rather the means 72 is a random or variable magnetizer with random Poles per inch (PPI), then the resultant magnetized sheet 76 will likewise have a varying/random PPI with poles lining up according to that section's density of poles per inch (PPI). However, the strength still depends on the AVERAGE Poles per inch.

Figure 7:
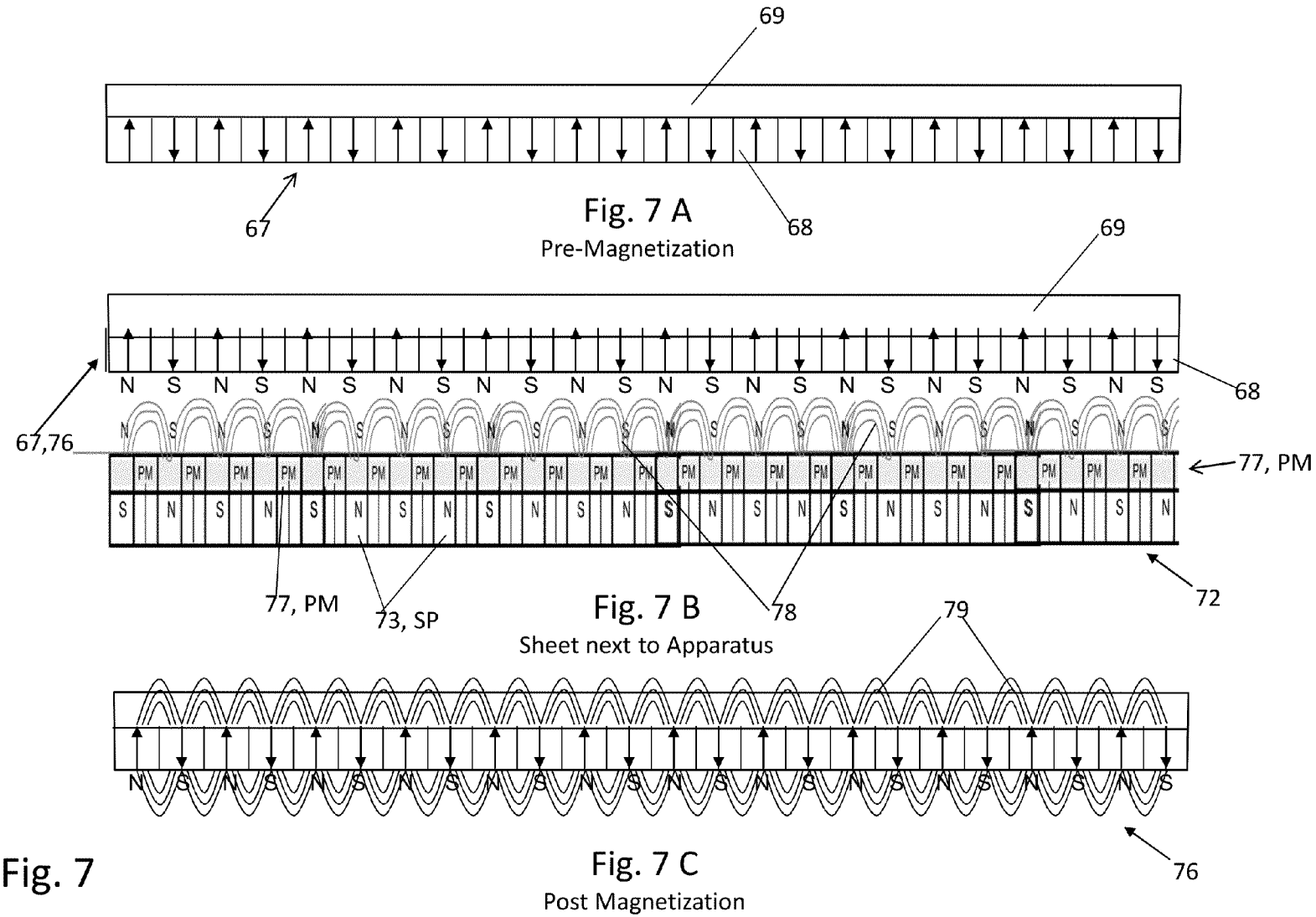
FIGS. 7 A through 7 C are sketches of a magnetizable sheet and the special magnetization apparatus for the thin magnetic sheets and rolls.

FIGS. 7 A through 7 C are sketches of a magnetizable sheet 67, the special magnetization apparatus 72 for the thin magnetic sheets and rolls, and the resultant magnetized sheet 76. In FIG. 7 A is the Pre-magnetized sheet 67. Next, when the sheet 67 is proximately placed next to the apparatus 72, one sees that the magnetic attractant 68 in the magnetizable sheet 67 is exposed (as shown in FIG. 7 B) to the flux lines 78 of the magnetizing means 72. The magnetizing means 72 of the apparatus can either rotate (as in the cylindrical embodiment 85 in FIG. 9) or remain stationary (as in the stationary embodiment 80 in FIG. 8) with respect to the magnetizing process. The permanent magnet PM, 77 pieces are magnetically oriented and magnetized perpendicular to the magnetically soft pole SP, 73 piece surfaces. (This is shown further in FIG. 13). The permanent magnets PM couple with the pole pieces SP and thereby adjustably control the field strength H of the magnetic field produced in the space defined by the pole pieces SP. The permanent magnets PM are preferably formed of rare earth material either NdFeB or SmCo which has a high remnant RE magnetic field 78 and a strong coercive force. By varying (or adjusting) the number of pole pieces per length (PPI) and the corresponding permanent magnets PM the magnetic coupling and magnetic field strength H subsequently varies. FIG. 7 C demonstrates the resulting post magnetized sheet 76 created by passing the sheet 67 or object proximately close to the apparatus 80, 85 with the means 72 for magnetizing (the soft 73 and permanent poles 77).

Figures 8, 8A, 8B, 8C, 8D, 8E, 8F, 8G:
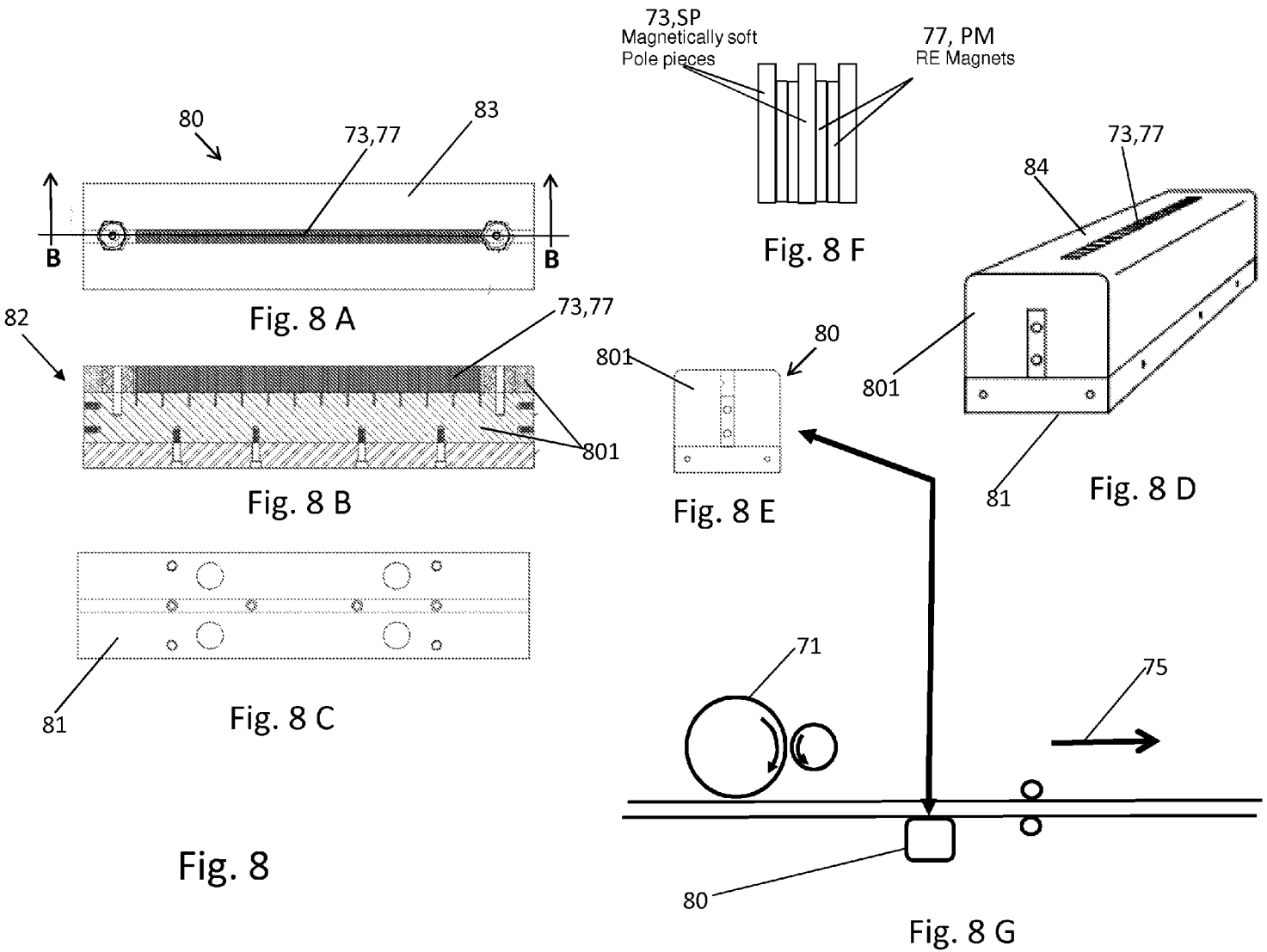
FIGS. 8 A through 8 G are sketches of a stationary magnetization apparatus and the component for randomly magnetizing the thin magnetic sheets and rolls.

FIGS. 8 A through 8 G are sketches of a stationary magnetization apparatus 80 and the components for randomly magnetizing the thin magnetic sheets 67 and rolls. Here the BOTTOM View 81, the Section View 82, the TOP View 83, and an ISOMETRIC View 84 are shown with the flow of the sheet 67 past the magnetizer 80. In FIG. 8 F the remnant/permanent magnet poles RE/PM/77 and the soft poles SP are highlighted. Also note the means 71 for coating a sheet and for moving a sheet past the magnetizer is shown in FIG. 8 G. Throughout the Figures one notes the means for containing 801 or container of the means for magnetizing 72.

Figures 9, 9A, 9B, 9C:
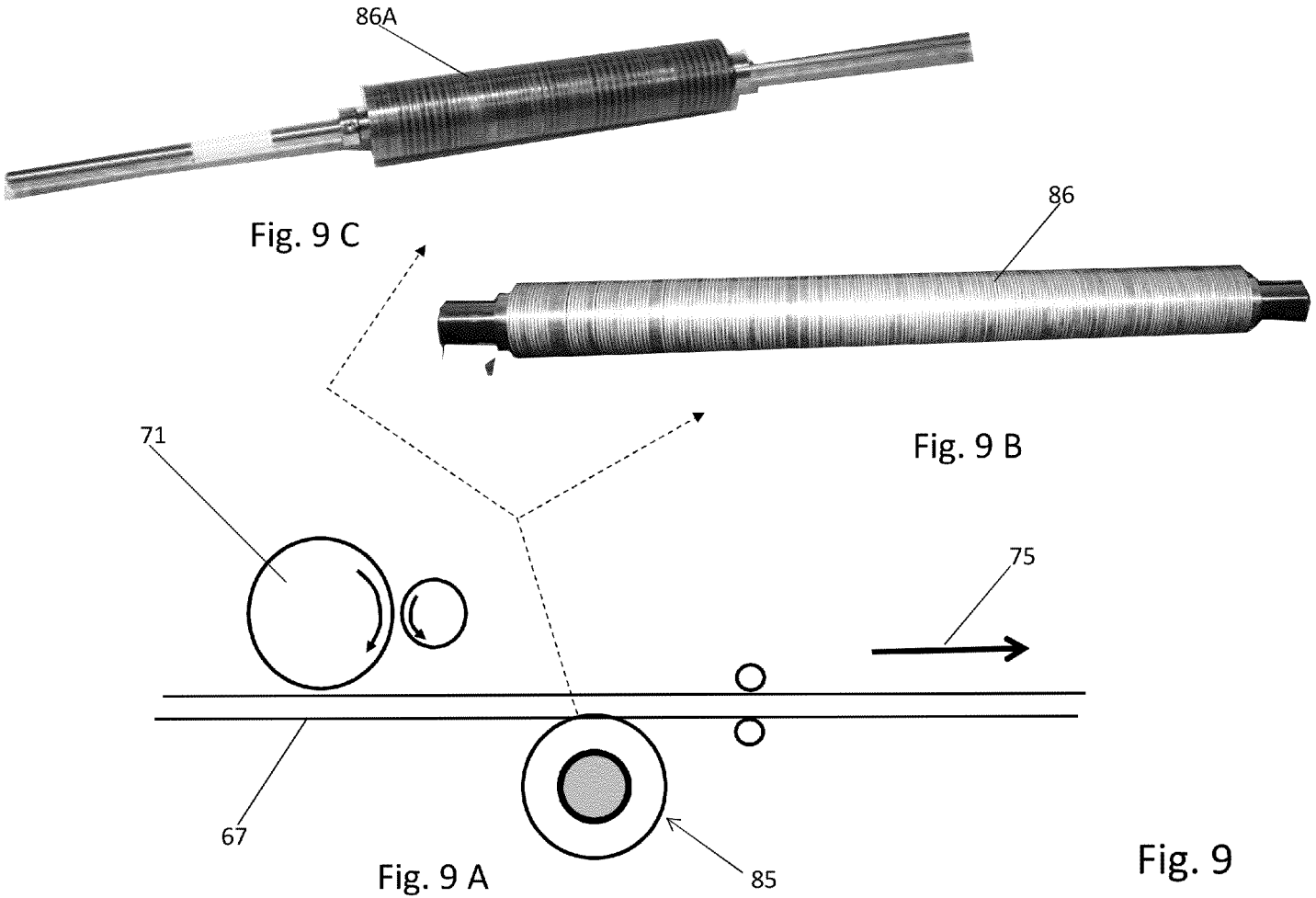
FIGS. 9 A through 9 C are sketches of an alternative cylindrical magnetization apparatus and the rollers for randomly magnetizing the thin magnetic sheets and rolls.

FIGS. 9 A through 9 C are sketches of an alternative cylindrical magnetization apparatus 85 and the rollers 86, 86A for randomly magnetizing the thin magnetic sheets 67 and rolls. The process is similar to the fixed device 80, except the cylindrical roller 86, 86A turns with the sheet 67 as it passes. Also, again note the means 71 for coating a sheet and for moving a sheet past the magnetizer is shown in FIG. 9 A.

Figure 10:
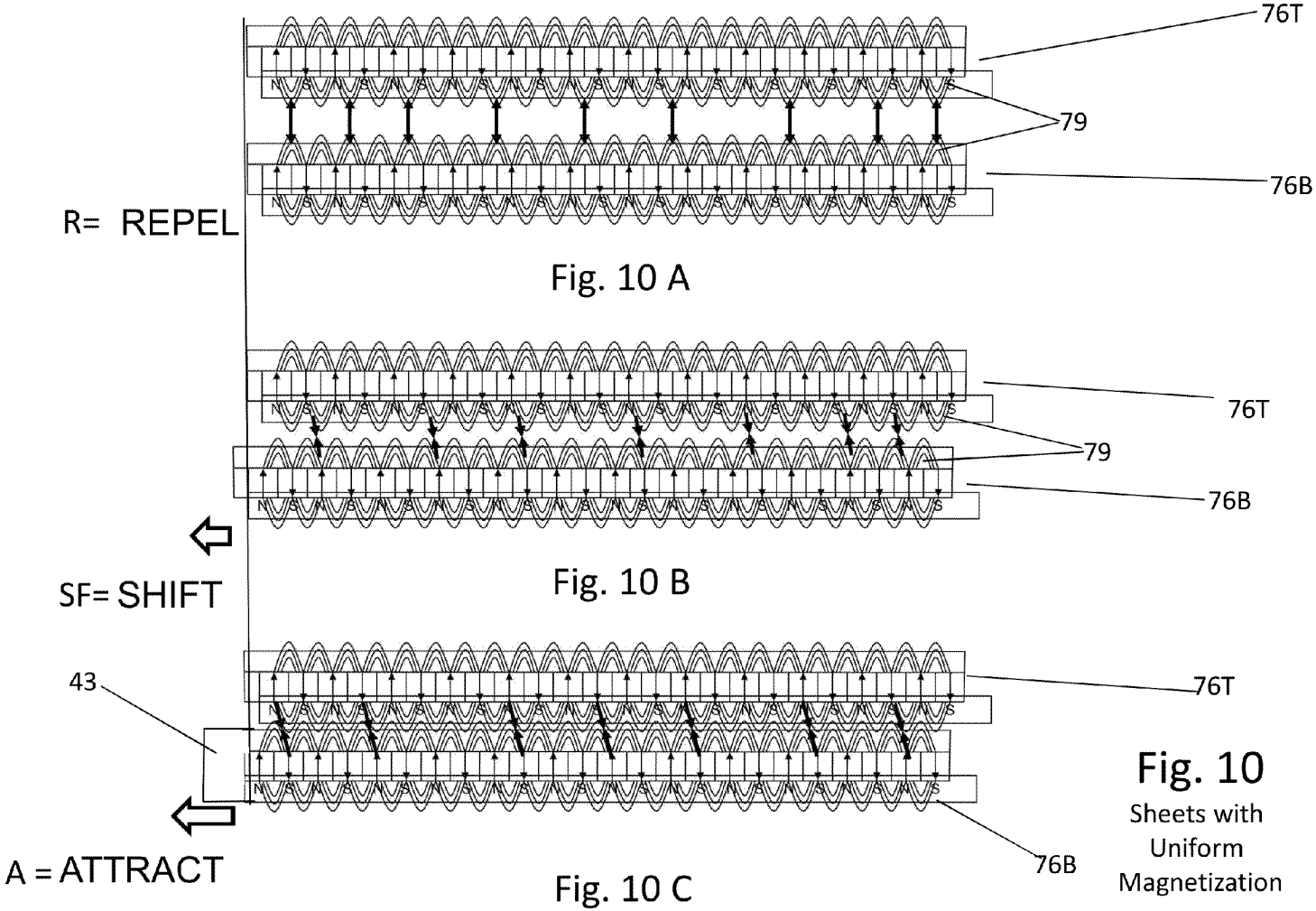
FIGS. 10 A through 10 C are sketches depicting the reaction and slipping/staggering of the uniformly magnetized sheets of the thin magnetic sheets and rolls. This staggering condition is the problem solved by the special random magnetization apparatus and process for thin sheet magnetic sheets and rolls.

FIGS. 10 A through 10 C are sketches depicting the reaction and slipping/staggering 43 of the uniformly magnetized sheets of the thin magnetic sheets 40 and rolls. This staggering condition is the problem solved by the special random magnetization apparatus and process for thin sheet magnetic sheets and rolls. In FIG. 10 A the two magnetized sheets (here shown as a top sheet 76T and a bottom, contiguous sheet 76B) are placed one on top of the other. The two sheets 76T and 76B are directly aligned and the two North Poles N REPEL each other through the flux 79. The contiguous sheets 76T and 76B will start to "Bounce" because of the thin and lightweight condition of the sheets do not compensate for the repelling force of the magnet poles. Then the sheets 76T, 76B start to SHIFT SH sideways as the sheets "float" on the flux 79, and they drift. This is cause by the attraction of the one North pole to the next unlike South pole. As the drift/shift continues, a North Pole and South Pole actually start to converge due to the magnetic attraction. Thus the Top sheet 76T floats and realigns from its North pole repelled by the Bottom sheet 76B North Pole to where the North pole of the Top sheet 76T is Attracted to the Bottom sheets 76B South pole, exactly one (1) pole away.

Figure 11:
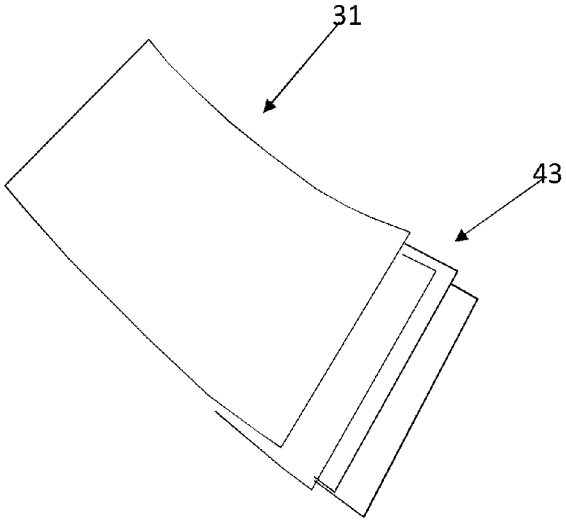
FIG. 11 is a repeat of a sketch of several sheets of a sample magnetized sheet. The edges are staggered since the sheets are uniformly magnetized.

FIG. 11 is a repeat of the sketch of several sheets of a sample magnetized sheet 31. The edges are staggered since the sheets are uniformly magnetized by the current state of the art processes.

Figure 12A:
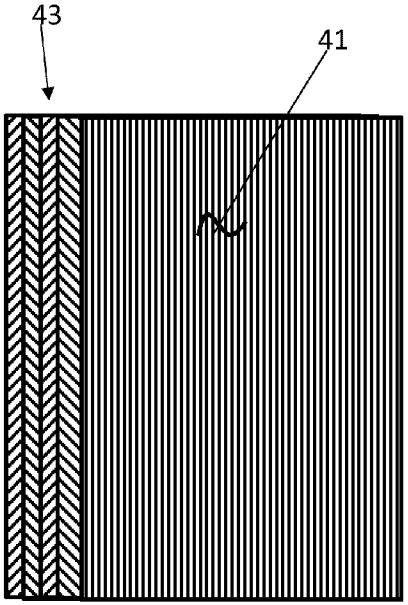
FIGS. 12 A through 12 B are sketches of a uniformly magnetized sheet from a TOP View and END View showing the staggering/slipping condition.
Figure 12B:
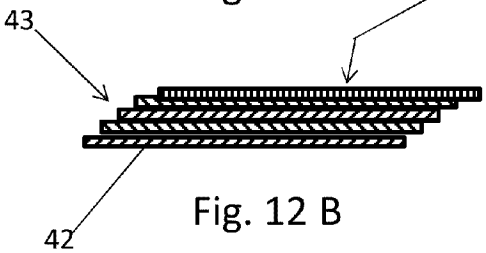

FIGS. 12 A through 12 B are sketches of a uniformly magnetized sheet from a TOP View and END View showing the staggering/slipping condition. This is a repeat of FIGS. 2 A through 2 C discussed above.

Figure 13:
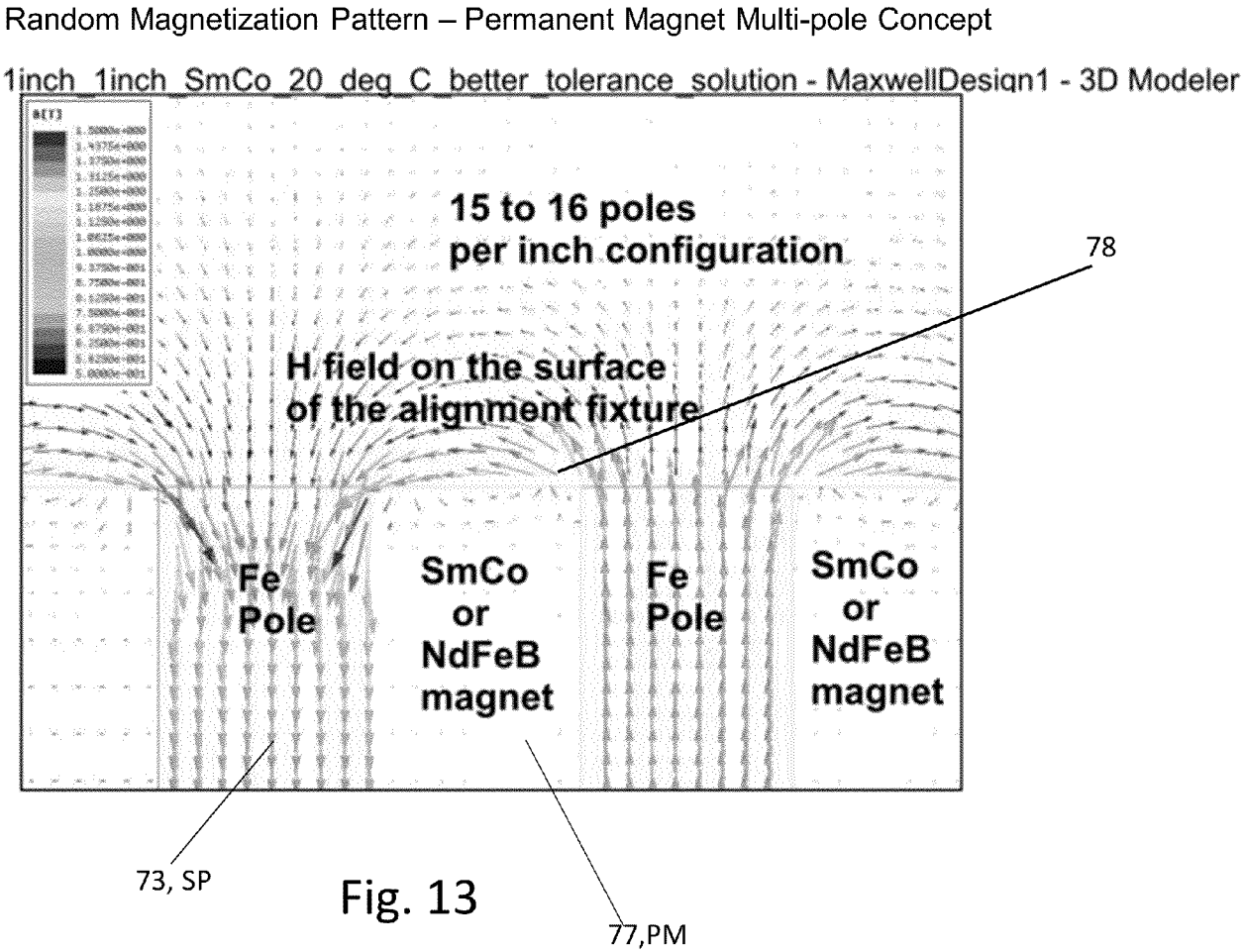
FIG. 13 shows a Random Magnetization Pattern for a random magnetizing means for randomly magnetizing the thin magnetic sheets and rolls.

FIG. 13 shows a Random Magnetization Pattern for a Random Magnetizing means for randomly magnetizing the thin magnetic sheets and rolls. The randomization in the magnetizing pattern is produced by varying the number of magnetic poles per inch resulting in narrowing or widening the magnetization pitch with multiple poles described above. This was discussed in Paragraph [0043], above.

Figure 14:
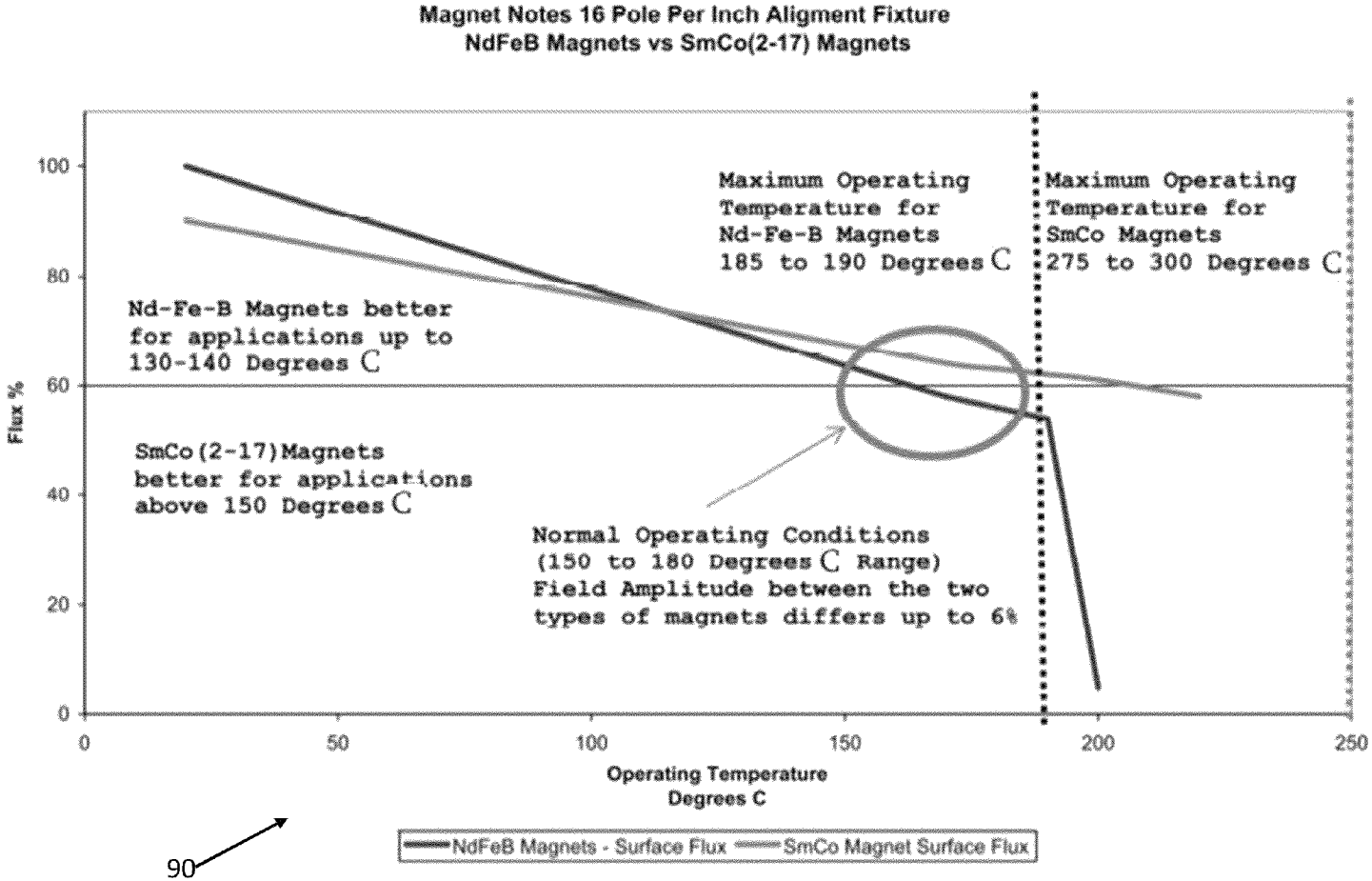
FIG. 14 shows an example of permanent magnets and the temperature versus magnetization field for a Random 15/16 PPI configuration.

FIG. 14 shows an example of permanent magnets and the temperature versus magnetization field for a Random 15/16 PPI configuration. The Magnetic Field H changes as the temperature changes. Here the preferred permanent magnets PM of rare earth material either NdFeB or SmCo which have a high remnant RE magnetic field 78 and a strong coercive force. One also notes the Maximum operating temperatures of the special magnets.

Figures 15A, 15B:
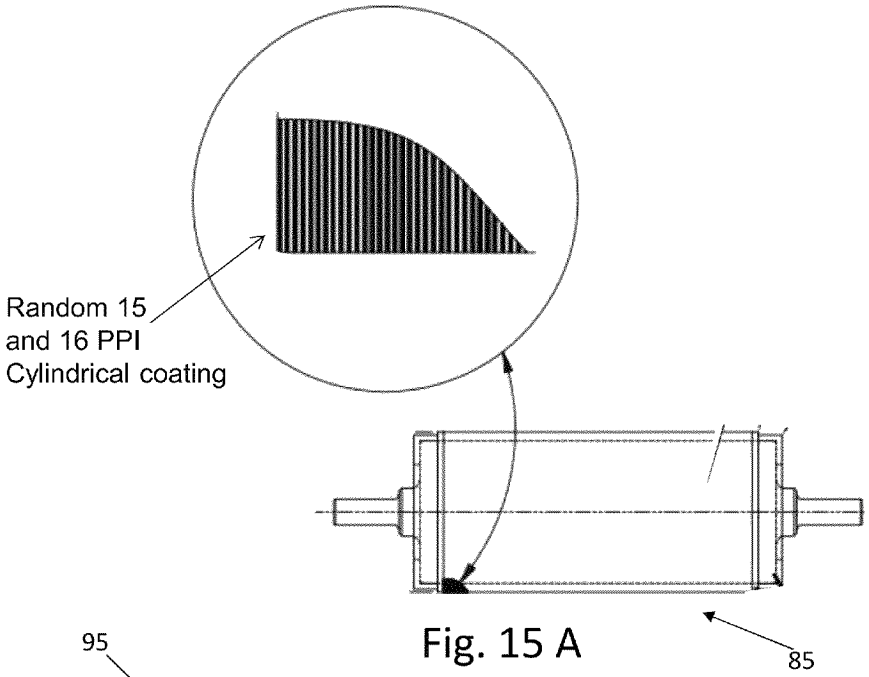
FIGS. 15 A and 15 B show the roller design for a cylindrical magnetization means and the equation used to get an average PPI condition for the random magnetizing roller. means for randomly magnetizing the thin magnetic sheets and rolls.

FIG. 15 A shows the roller design for a cylindrical magnetization means 85. The PPI varies and permits the magnetizing means to transfer the variation to the sheet 67 that passes. Therefore the magnetized sheet 76 takes on the similar random characteristic. Each sheet thus has a variable or random PPI and the attraction forces shown in FIGS. 10 A through C, above, are "confused" and misaligned and do not create a "repel/bounce/shift" attract phenomena. In FIG. 15 A, the PM roller design is shown with and extended active length (where the magnetization occurs) and a random 15/16 PPI magnetic orientation. Also (but not visible) the magnet thickness went from approximately ½ inch to ¾ inch. FIG. 15 B shows the example equation used to get an Average PPI condition for the random magnetizing roller.

So:

$$\mathrm{PPI(AVG)}=PA=\{[(PA+1)*4]+[(PA-2)*4]+[(PA)*4]+[(PA+2)*2]+[(PA-2)*3]+[(PA+1)*4]+[PA*2]+[(PA+2)*1]\}/24$$

The average remains the same as the density increases and decreases. So the average equals what a uniform 15 or 16 PPI magnetizing unit would emanate in flux fields—but the sectional PPI varies and thus the poles are mis-aligned. One skilled in the art realizes too that the example average equation is accurate but still continues to appreciate that the magnetic attraction force between two magnetic layers is determined by not only the average number of poles per inch (PPI) but also the magnetic flux density of the magnetic material magnetized and the area of each magnetic pole. Thus, the attraction (A) or repelling (R) force (F) is equal to (or proportional to) n (the number of poles) B^2 (magnetic flux density of the magnet material squared) and A (the total area of the (air) gap between the two magnetic layers) so once the air gap between the two sheets is zero (0) the force value is proportional to n*B^2A—where A is the total magnet or pole area at contact for all poles.

Figures 16, 17A, 17B, 17C, 18A, 18B, 18C:
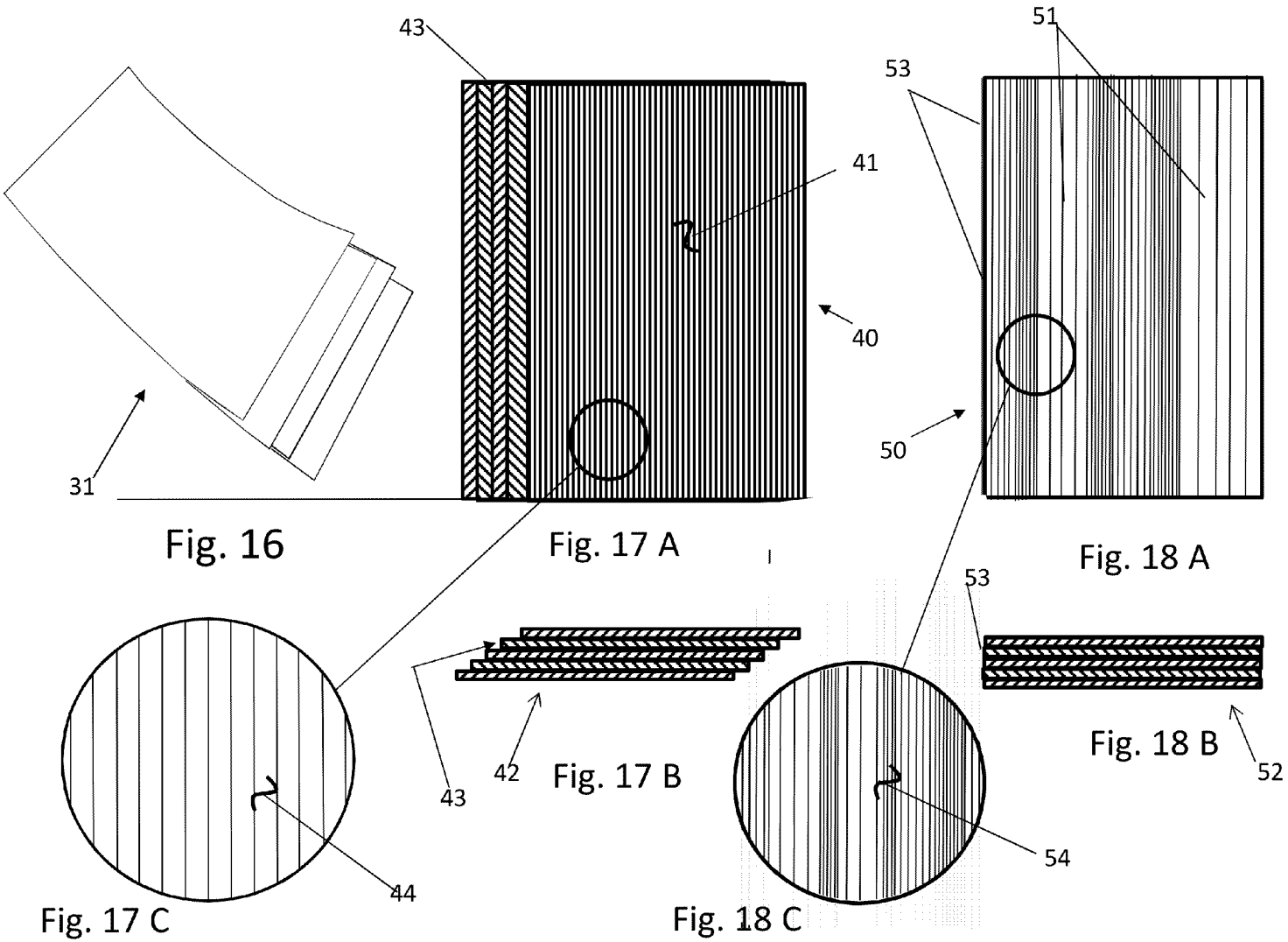
FIG. 16 is a repeat of a sketch of several sheets of a sample magnetized sheet. The edges are staggered since the sheets are uniformly magnetized.

FIG. 16 is a repeat of the FIG. 1 sketch and is reshown as part of a summary. The edges are staggered since the sheets are uniformly magnetized. FIGS. 17 A through 17 C are sketches of a uniformly magnetized sheet from a TOP View, END View and CLOSE-UP showing the staggering/slipping condition. FIGS. 18 A through 18 C are sketches of a randomly magnetized sheet from a TOP View, END View and CLOSE-UP showing the smooth edge/no stager condition. Thus the random magnetization results in sheets that do not stagger and are easily handled.

All of the details mentioned here are exemplary and not limiting. Other specific components and manners of use specific to describing a special magnetization apparatus and process for thin sheet magnetic sheets and rolls may be added as a person having ordinary skill in the field of magnetization well appreciates.

Operation of the Preferred Embodiment

The special magnetization apparatus and process for thin sheet magnetic sheets and rolls has been described in the above embodiment. The manner of how the device operates was described as well. The paragraphs above describe a magnetization apparatus and process for producing thin magnetized sheets and rolls. The device has permanent magnet pieces oriented and magnetized perpendicular to the other components of soft pole piece surfaces. This orientation permits the adjustably controlled field strength of the magnetic field produced. By varying the number of pole pieces and the corresponding permanent magnets the magnetic coupling and magnetic field strength varies. This field variance shifts the aligned poles into a "random orientation". Therefor the alignment of like poles on the consecutive sheets is avoided and the sheets can lay flat and not be repelled by aligned poles. One notes well that both the description and operation above must be taken together to fully illustrate the concept of the special magnetization apparatus and process for thin sheet magnetic sheets and rolls. The preferred embodiment of the special magnetization apparatus is comprised of two or more magnetically-soft pole pieces and two or more permanent magnets which are provided between the magnetically-soft pole pieces (either cylindrical rings or rectangular blocks). This is to provide magnetic flux to the magnetic field. The magnetic field is defined by the space between the two magnetically soft pole pieces and can vary in magnetic strength based on magnetization quality of the magnetically soft material and the magnetic quality and volume of permanent magnet material. The apparatus can either rotate or remain stationary with respect to the magnetizing process.

The preferred embodiment is a magnetization apparatus for magnetizing a magnetizeable sheet and object comprised of at least one magnetically-soft pole piece; at least a pole piece pair consisting of a North and a South permanent magnet pole piece of a given size and volume, the permanent poles which are contiguously placed on each side of the magnetically-soft pole piece(s), whereby the soft piece(s) creating a defined space between the permanent pole pieces; a means for containing a totality of pole pieces comprised of the soft pole piece(s) and the permanent magnetic pole pieces into a specific configuration which acts as a magnetic source; and a means for moving the sheet in a close proximity to the magnetization apparatus wherein the apparatus provides a magnetic flux to the sheet defined by the from the pole pieces and the defined space of the soft pole(s) to produce a magnetic field that can vary in magnetic strength based on magnetization quality of the material and number of the soft pole piece(s) and the volume of permanent magnet material.

Many uses are anticipated for the special magnetization apparatus and process for thin sheet magnetic sheets and rolls and were listed in the description, application and preliminary information shown above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the special magnetization apparatus and process for thin sheet magnetic sheets and rolls is not to be limited to only the disclosed embodiment of product. The features of the device are intended to cover various modifications and equivalent arrangements included within the spirit and scope of the description.

What is claimed is:

1. A magnetization apparatus for random magnetizing a magnetizable thin sheet and object comprised of (a) at least two magnetically-soft pole pieces;

(b) at least two pole piece pairs, each of the pairs consisting of a North and a South permanent magnet pole piece of a random (magnetic) poles per inch and each of the at least two pole piece pairs being of different pole per inch strength, the different and random permanent poles which are contiguously placed on each side of the magnetically-soft pole piece(s), whereby the soft piece(s) creating a defined and random strength and space between the different and random permanent pole pieces;

(c) a means for containing a totality of pole pieces comprised of the soft pole piece(s) and the permanent magnetic pole pieces into a specific configuration which acts as a magnetic source; and, (d) a means for moving the sheet in a close proximity to the magnetization apparatus wherein the apparatus provides a randomized magnetic flux to the magnetizable thin sheet defined by the different and random permanent pole pieces and the defined space of the soft pole(s) to produce a randomized magnetic field that can vary in magnetic strength based on magnetization quality of the material and number of the soft pole piece(s) and the volume of permanent magnet material.

2. The device in claim 1 wherein the means for containing a totality of pole pieces is a stationary block apparatus for magnetizing the object.

3. The device in claim 1 wherein the means for containing a totality of pole pieces is a rotatable, cylindrical apparatus for magnetizing the sheet and object.

4. The device according to claim 1 wherein the object for magnetizing is selected from the group consisting of paper sheet, card, plastic, metal sheet, and composite material sheet.

5. A magnetization apparatus for magnetizing a magnetizable thin sheet and object comprised of (a) at least two magnetically-soft pole pieces;

(b) at least two pole piece pairs, each of the pairs consisting of a North and a South permanent magnet pole piece of a random (magnetic) poles per inch and each of the at least two pole piece pairs being of different pole per inch strength, the different and random permanent poles which are contiguously placed on each side of the magnetically-soft pole piece(s), whereby the soft piece(s) creating a defined and random strength and space between the different and random permanent pole pieces;

(c) a means configured as a rotatable, cylindrical apparatus for magnetizing the magnetizable thin sheet the cylindrical apparatus which contains a totality of pole pieces comprised of the soft pole piece(s) and the permanent magnetic pole pieces into a specific configuration which acts as a magnetic source; and, (d) a means for moving the sheet in a close proximity to the magnetization apparatus wherein the apparatus provides a magnetic flux to the magnetizable thin sheet defined by the from the pole pieces and the defined space of the soft pole(s) to produce a magnetic field that can vary in magnetic strength based on magnetization quality of the material and number of the soft pole piece(s) and the volume of permanent magnet material.

* * * * *